US005203684A

United States Patent [19]

Henriksen

[11] Patent Number: 5,203,684

[45] Date of Patent: Apr. 20, 1993

[54] OSCILLATING PISTON PUMP OR SIMILAR MACHINE

[75] Inventor: Leif D. Henriksen, Porsgrunn, Norway

[73] Assignee: 3H Invent A/S, Skien, Norway

[21] Appl. No.: 721,583

[22] PCT Filed: Feb. 1, 1990

[86] PCT No.: PCT/NO90/00022

§ 371 Date: Aug. 28, 1991

§ 102(e) Date: Aug. 28, 1991

[87] PCT Pub. No.: WO90/08902

PCT Pub. Date: Aug. 9, 1990

[30] Foreign Application Priority Data

Feb. 3, 1989 [NO] Norway ..... 890436

[51] Int. Cl.[5] ..... F04C 21/00

[52] U.S. Cl. ..... 417/484; 417/482

[58] Field of Search ..... 417/360, 481, 482, 483, 417/484; 92/121, 120, 122, 123, 124, 125

[56] References Cited

U.S. PATENT DOCUMENTS 1,516,584 11/1924 Wilson ..... 417/482

*Primary Examiner*—Richard A. Bertsch
*Assistant Examiner*—Roland McAndrews
*Attorney, Agent, or Firm*—Francis C. Hand

[57] ABSTRACT

The compressor or similar machine has a first housing component which cooperates with two end members to form a first hollow space as well as a second housing component which cooperates with two end members to form a second hollow space. In addition, a one-piece rocking piston member extends through the two housing components. The piston member carries radially directed wings at one end which are received in the first hollow space while a cylindrical portion is received in the second hollow space for coupling with a crank arm mechanism. The hollow spaces are sealed off relative to each other by a sealing ring which is arranged on the piston member. The piston member is secured in place by a cover member which is bolted to one end member associated with the second housing component. Similar bolt secure the end members associated with the second housing component together.

5 Claims, 1 Drawing Sheet

OSCILLATING PISTON PUMP OR SIMILAR MACHINE

The present invention relates to an arrangement of pumps, compressors, motors or similar machines, comprising a machine housing having a first housing component, which together with a pair of mutually opposite end members and one or more pairs of mutually diametrically opposite partition walls projecting radially inwards define a first hollow space which surrounds a rocker piston member with associated hub portion and from the latter piston wings projecting radially outwards, and a second housing component, which together with a pair of end members define a second hollow space which surrounds a crank arm mechanism for subjecting the rocker piston member to an oscillating movement. With the present invention, the aim is an especially simple constructional solution where relatively few separate parts can be employed and where the parts can be assembled together in a simple and ready manner. The objective is a solution which is especially suitable for high speed machines, that is to say with a speed of for example 10–20,000 oscillations per minute. In addition, the aim is a solution which is reliable in use. The arrangement is characterised in that the housing components with associated end members and the rocker piston member with associated piston wings and hub portion are axially displaceably arranged relative to each other. The housing components with at least the one associated end member are being easily releasably connected to each other via the hub portion of the rocker piston member, which in one piece spans over the first and second hollow spaces. The hollow spaces of the first housing component and of the second housing component are separately defined relative to the hub portion of the rocker piston member, the hollow spaces being sealed off relative to each other by means of a sealing ring which is arranged on the common hub portion between the one end member of the first housing component and the one end member of the second housing component and/or between the one end member of the first housing component and a bearing in one end member of the second housing component.

By means of a rocker piston member in one piece, one is able to achieve according to the invention coupling together of different components which form a part of the machine in an especially simple and easy manner with a small number of coupling means and by means of simple assembling and disassembling operations. Furthermore, a solution is achieved which by its simple design and with its relatively small number of parts has large operational and useful advantages, such as compact construction and low weight. Special advantages are achieved by limiting and completely separating the two hollow spaces in an especially simple and effective manner, that is to say the work chamber-forming hollow space and the lubricant-receiving hollow space, in a fluid-tight and gas-tight manner relative to each other, so that the penetration of lubricant into the work chambers can be avoided, at the same time as an effective lubrication of the parts which are received in the lubricant-receiving hollow space can be ensured.

Special advantages are obtained furthermore in that the hub portion of the rocker piston member is rotatably disposed in bearings in mutually opposite end components of the second housing component, the hub portion being extended from said bearing in the one end member of the second housing component past the coupling-together region of the hub portion for the crank arm mechanism to a second bearing in the other end member of the second housing component, while at the opposite end, by the associated piston wings, the hub portion projects free endingly inwards into the hollow space of the first housing component.

In this way, the rocker piston member can be mounted exclusively or almost exclusively in the end members of the second housing component. In the case of a compressor or pump, a rotary movement can be converted from a drive shaft via the crank arm mechanism in the second hollow space to an oscillatory movement for the rocker piston member, and in the case of a motor an oscillatory movement for the rocker piston member can be converted to a rotary movement for a driven shaft—in a region between opposite bearings of the hub portion—at the same time as piston wings of the rocker piston member can be moved in a free and intentionally accurate manner in the associated first hollow space in the first housing component.

The arrangement according to the invention is further characterised in that the first housing component with associated partition walls and associated end members are fixed between a cover member and the one end member of the second housing component and are fastened to the one end member by means of tightening means which are arranged radially outside the first housing component. The first housing component with associated partition walls and the end members of the first housing component are tightened together axially in mutual sealing abutment, while the hub portion of the rocker piston member and piston wings are arranged freely pivotable in the hollow space between the first housing component and its end members With such a solution, easy and precise mounting of the members which enter into combination with the first housing component is achieved. More specifically, for example the hollow space of the first housing component can be readily placed in communication via radial medium inlet openings in the hub portion of the rockter piston member with a medium intake which is arranged centrally in the axially adjacent cover member of the machine housing and via axial medium outlet openings in the one end member of the first housing component be placed in communication with a medium outlet in the cover member radially outside the medium intake.

It is preferred that the hub portion of the rockter piston member constitutes a relatively thin-walled hollow body.

With relatively little material and with relatively large strength there can be obtained by this an especially rapid oscillatory movement with a large transmission of power in the machine, based on an especially high speed machine Further features of the present invention will be evident from the following description having regard to the accompanying drawings, in which.

Figure 1:
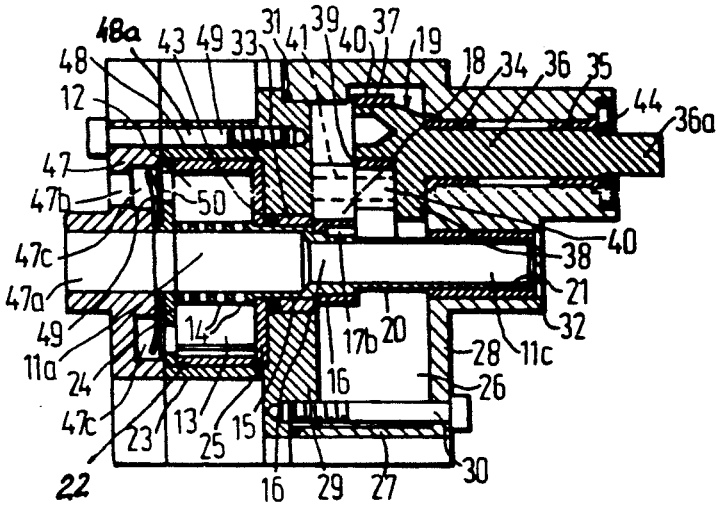
FIG. 1 shows a longitudinal section of a machine according to the invention.

In FIG. 1 there is shown a machine according to the invention, in the form of a compressor. The machine can also be employed as a hydraulic pump or hydraulic motor. With certain modifications the machine can also be employed as another power transmission machine.

Figure 2:
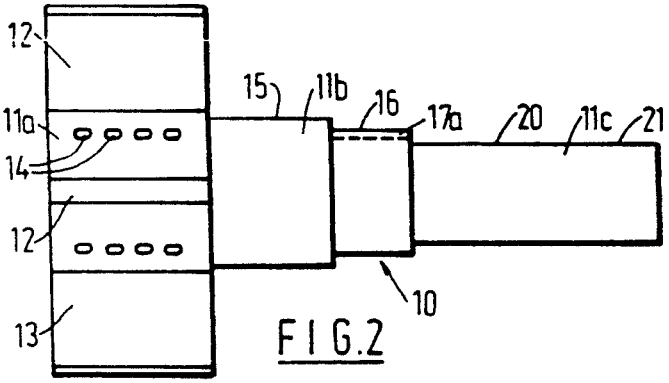
FIG. 2 shows a side elevation of a rocker piston member according to the invention.

The machine is illustrated with a piston rocker member 10 having an elongate hub portion 11 associated with two pairs of mutually oppositely directed piston wings 12, 13 projecting radially outwards at one end 11*a* of the hub portion. The hub portion 11 (see FIG. 2) is shown in the form of a light weight, pipe-shaped construction of moderate wall thickness at one end 11*a* and at a first part of a middle portion 11*b* and of minimal wall thickness at a second part of the middle portion 11*b* and at the other end 11*c* of the hub portion 11. A series of bores 14 are formed transversely through the end 11*a* of the pipe-shaped hub portion 11 between each pair of piston wings 12, 13. Each series of bores 14 (or alternatively a series of slots or a coherent slot) form medium intakes to their respective pairs of work chambers described further below). Just behind the piston wings 12, 13 there is defined on the hub portion 11, a first cylindrical bearing surface 15. Next follows a radially stepped, second cylindrical surface 16 for engagement, via a key groove 17*a* and key 17*b* or a "spline" (see FIG. 1) with a drive member 18 of a jointed drive arm mechanism 19 Just behind the surface 16, the hub portion 11 is further radially stepped with a cylindric third surface 20 which at the end 11*c* forms a second bearing surface 21 for the hub portion 11 (see FIG. 2). The hub portion 11 is stepped gradually from the one end 11*a* to the other end 11*c*, so that the rocker piston member 10 can be pushed axially in place into engagement, one after the other, with various cooperating members, as will be described further below.

The rocker piston member 10 passes through a first hollow space 22, (FIG. 3) which is defined between a first cylindrical housing component 23 and two mutually opposite, individually separate, disc-shaped end members 24, 25, and passes through a second hollow space 26 (FIG. 1), which is defined between a second cylindrical housing component 27 having a permanent end member or bottom member 28 and a removeable, disc-shaped end member or cover member 29.

The end member 29 is readily releasably fastened to the housing component 27 by means of fastening bolts 30 (only one is shown in FIG. 1) and by means of an intermediate seal 31 sealed off relative to the housing component 27 to form an oil chamber in the hollow space 26. The oil chamber can for example be replenished via an oil nipple not shown further on the housing component 27. By means of the oil medium in the hollow space 26, the bearing surfaces 15 and 21 of the hub portion 11 and equivalent bearing surfaces of a bearing lining 32 in the end member 28 and of a bearing lining 33 in the end member 29 can be lubricated. In this respect, as illustrated, the piston member 10 projects into the first hollow space 22 from the second housing component 27 in cantilevered manner.

A drive arm mechanism 19 for the rocker piston member 10 is received in the hollow space 26. In the end member 28, there is rotatably mounted in bearings 34 and 35 a rotary shaft 36 having an eccentrically arranged, axially directed drive pin 37 and a laterally directed counterweight 38 arranged diametrically opposite. The drive pin 37 is rotatably mounted in a bore 39 in a first crank member 40. The other end of the crank member 40 is provided with an axially directed crank pin 41 which projects axially inwardly into and is rotatably mounted in a bore in the one end of a second crank member, which forms a drive member 18 of the rocker piston member 10. The opposite end of the drive member 18 engages the hub portion 11 of the rocker piston member 10 via the second surface 16 and is in drive connection with the surface 16 via the key groove/spline 17*a* and key 17*b*.

The rocker piston member 10 can be pushed axially into place together with the one end member 25 of the first housing component 23 on the end member (cover) 29 of the second housing component 27 with a single sealing ring 43 arranged between the end member 25 and the end member 29 together with the associated bearing lining 33. By this, the members can be pushed into place in a simple and ready manner relative to each other and the members sealed off in a reliable manner relative to each other and by way of simple means. Thereafter, the drive arm mechanism 19 can be mounted in place on the rocker piston member 10 and finally the rotary shaft 36 can be pushed into place in the bearings 34, 35 of the bottom member 28 of the housing component 27. By means of a lip seal 44, the rotary shaft 36 can be sealed off relative to the housing component 27, an elongate portion 36*a* of the rotary shaft 36 projecting endways outside the housing component 27 and being able to be connected to a drive member, such as a drive motor (not shown)—in case the machine is a pump or compressor—or to a driven member—in case the machine is a motor. By means of the fastening bolts 30 and the sealing ring 31, the hollow space 26 can be simply and readily sealed off in the passage between the end member 29 and the housing member 27.

It is possible with the rocker piston member 10 in place in the housing component 27 to maintain the oil medium in the oil chamber, while the end member 24 and the housing component 23 are removed from the rocker piston member in order to provide access to vital portions 11, 12, 13 and the bores 14 of the rocker piston member.

To the first housing component 23, there are fastened two pairs of diametrically opposite partition walls 23*a* and 23*b* projecting radially inwards which define between them two pairs of equivalent hollow space sections. Each hollow space section is partitioned again, by means of a respective one of the two pairs of piston wings 12 and 13 of the rocker piston member 10, into a pair of equivalent work chambers (eight work chambers in all). Each work chamber is consequently defined between the housing component 23 and a partition wall 23*a* and 23*b* respectively and the two opposite end members 24, 25 on the one side and the hub portion 11 of the rocker piston member 10 and a respective one piston wing 12 and 13 on the other side 43. In the one end wall 24, there are cut out four pairs of axially extending port openings 45, 46, that is to say a port opening in each of the eight work chambers or a port opening 45 on the one side of a respective piston wing and a port opening 46 on the other side of the piston wing. During osciallation of the rocker piston member 10, the opening and closing of the bores 14 in the hub portion 11 of the rocker piston member 10 is controlled by the rocking movement of the hub portion 11 relative to a respective partition wall 23*a*, 23*b*, there being employed common bores 14 (slots 14' shown in FIG. 3) for two work chambers on opposite sides of the respective partition wall 23*a*, 23*b*.

Axially outside the one end member 24 of the housing component 23, a cover member 47 is arranged and between end member 29 of the second housing component 27 and the cover member 47 a spacing-forming holder member 48 is arranged which surrounds the housing component 23 and its end members 24, 25 By means of axially extending fastening bolts 48*a* (only one is shown in FIG. 1) the cover member 47 and the holder member 48 are fastened in a mutually flush position and permanently anchored to the end member 29 with the housing component 23 and the partition walls 23*a* together with the end walls 24, 25 firmly clamped in mutual sealing engagement with each other between the cover member 47 and the end member 29.

As desired, one can either a) by releasing the fastening bolts 30, draw together the rocker piston member 10 with the cover member 47, the holder member 48 and the end member 29 together with the housing component 23 and the end members 24, 25, as a coherent unit out of engagement with the housing component 27 and the crank arm mechanism 19 or b) by releasing the fastening bolts 48*a*, draw the rocker piston member 10 together with the housing component 23 and the end members 24 and 25 together with the cover member 47 and the holder member 48 out of engagement with the end member 29 and the members fastened to this or only draw the housing component 23 and the end member 24 together with the cover member 47 and the holder member 48 away from the rocker piston member 10 and the end member 25, while the last-mentioned members 10 and 25 are still engaged to the end member 29 and the members fastened to this. By this, one has the possibility of providing easy access to the various members of the machine in a readily controllable manner with the aid of few and simple means, by a simple mutual axial displacement of the members relative to each other. The rocker piston member 10 forms by this a common connecting means and control means between the members. By means of a single sealing ring 43 on hub portion 11 of the rocker piston member 10, an effective sealing off between the hollow spaces 22 and 26 can be ensured along hub portion 11 of the rocker piston member 10.

Centrally in the cover member 47, there is designed a medium intake 47*a* which is aligned with and communicates with the internal hollow space in hub portion 11 of the rocker piston member 10 at its free end 11*a* and radially outside the medium intake 47*a* there is arranged a medium outlet 47*b* which communicates with a discharge chamber 47*c* which forms a connection between the medium outlet 47*b* and the port openings 45, 46. In the discharge chamber, there is arranged a star-shaped support member 49 and a star-shaped valve member 50. The support member and the valve member are each provided with eight finger-shaped portions 49*a* and 50*a* respectively which are arranged axially just outside their respective port openings 45, 46. Support member 49 of the valve member 50 allows the finger-shaped portions of the valve member 50 to be pivotable between the closed position illustrated in FIG. 1 and an open position with supporting abutment against the support member 49, with excess pressure prevailing in the respective work chambers relative to the discharge chamber 47*c*. The finger-shaped portions of the valve member 50 can be pivoted around in the opposite direction with the occurrence of reduced pressure in the respective work chambers relative to the pressure which prevails in the discharge chamber 47*c*.

Figure 3:
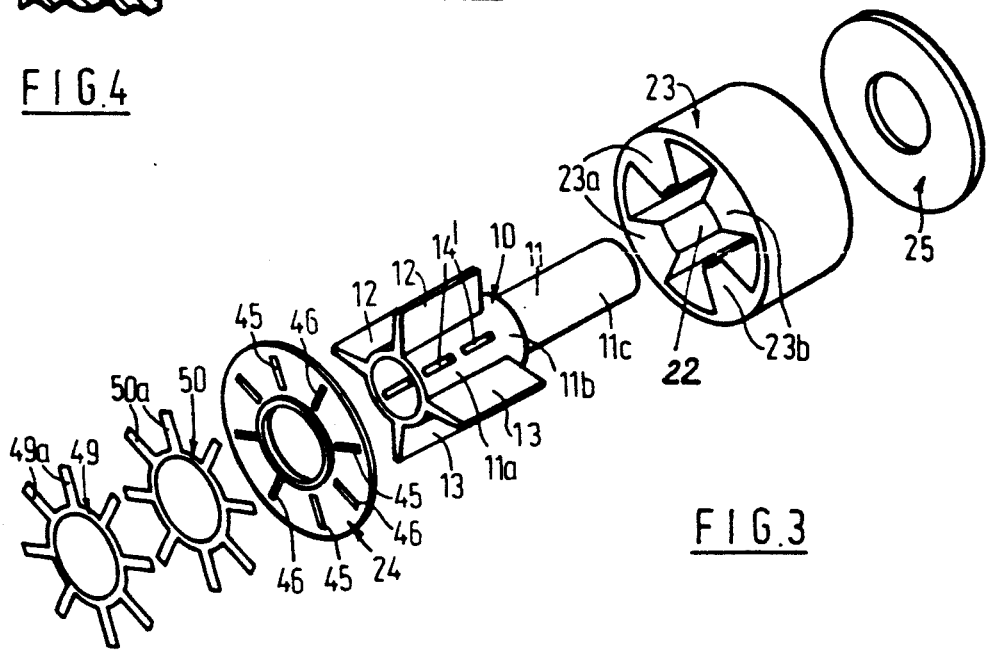
FIG. 3 shows an exploded view of certain members of the machine.

As indicated in FIG. 3, the members 25, 23, 10, 24, 50 and 49 can be drawn axially from each other after the cover member 47 and the holder member 48 are disassembled (FIG. 1).

Figure 4:
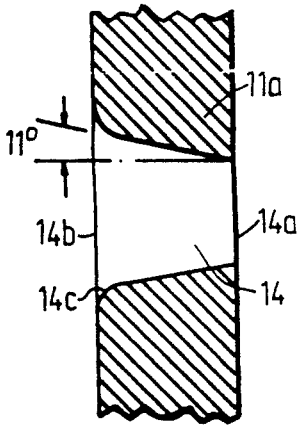
FIG. 4 shows a detail of the inlet ports of the machine.

In FIG. 4 there is shown an opening valve of 22° between the inlet opening 14*a* and the outlet opening 14*b*. In addition, there is shown a rounded-off transition portion 14*c* at the outlet opening. By means of the illustrated placing (FIG. 1 and 2) and the illustrated design (FIG. 4) of the inlet ports 14 several advantages are obtained. Firstly better filling of the work chambers. Furthermore, one obtains a reduction of noise on filling and simplification of the machining of the ports.

I claim:

1. In combination a first housing component having a plurality of radially inwardly directed partition walls;

a first pair of mutually opposite end members, each end member being disposed at a respective end of said first housing component to define a first hollow space therewith;

a second housing component;

a second pair of mutually opposite end members, each said end member of said second pair being disposed at a respective end of said second housing component to define a second hollow space therewith;

a one-piece rocker piston member slidably mounted in and extending within each said housing component, said piston member having a plurality of radically directed wings disposed in alternating relation with said partition walls and a cylindrical surface in said second hollow space;

a crank arm mechanism in said second hollow space coupled to said cylindrical surface of said piston member for oscillating said piston member;

a sealing ring sealingly engaging about said piston member and located in sealing contact with at least one of said end members of said housing components to seal said hollow spaces from each other along said piston member;

a cover member on a side of said first housing component opposite said second housing component; and connecting means removably connecting said cover member to said second housing component.

2. The combination as set forth in claim 1 which further comprises connecting means removably connecting end members and wherein one of said end members of said second pair is integral with said second housing component.

3. The combination as set forth in claim 1 wherein said piston member is a thin-walled hollow body.

4. The combination as set forth in claim 1 which further comprises a pair of bearings, each bearing being disposed in a respective end member adjacent said second housing component and rotatably receiving said piston member therein.

5. The combination as set forth in claim 4 wherein said piston member projects into said first hollow space from said second housing component in cantilevered manner.

* * * * *